United States Patent [19]

Saiki et al.

[11] 4,426,556

[45] Jan. 17, 1984

[54] ELECTRODYNAMIC LOUDSPEAKER

[75] Inventors: Shuji Saiki, Hirakata; Katuaki Sato, Osaka; Kazue Sato; Seiichi Ishikawa, both of Kadoma; Hideaki Inoue, Neyagawa; Tsuneo Tanaka, Nishinomiya, all of Japan

[73] Assignee: Matsushita Electric Industrial Co., Ltd., Osaka, Japan

[21] Appl. No.: 281,167

[22] Filed: Jul. 7, 1981

[30] Foreign Application Priority Data

| | | | |
|---|---|---|---|
| Jul. 8, 1980 | [JP] | Japan | 55-93646 |
| Oct. 8, 1980 | [JP] | Japan | 55-141691 |
| Feb. 19, 1981 | [JP] | Japan | 56-24114 |

[51] Int. Cl.[3] ..... H04R 9/00; H04R 9/06

[52] U.S. Cl. ..... 179/115.5 DV; 179/115.5 R; 179/116; 179/181 R; 181/157; 181/166

[58] Field of Search ..... 179/115.5 DV, 115.5 R, 179/181 R, 116, 115.5 ES, 181 R, 181 F, 102; 181/164, 166, 171, 156, 157

[56] References Cited

U.S. PATENT DOCUMENTS

| | | | |
|---|---|---|---|
| 2,007,746 | 7/1935 | Ringel | 179/115.5 DV |
| 2,956,538 | 10/1960 | Rich | 116/DIG. 18 |
| 4,225,757 | 9/1980 | Babb | 179/115.5 R |
| 4,252,211 | 2/1981 | Matsuda et al. | 181/166 |

FOREIGN PATENT DOCUMENTS

| | | | |
|---|---|---|---|
| 55-66196 | 5/1980 | Japan | 179/115.5 ES |
| 1003608 | 1/1962 | United Kingdom | 181/167 |

*Primary Examiner*—Gene Z. Rubinson
*Assistant Examiner*—Danita R. Byrd
*Attorney, Agent, or Firm*—Birch, Stewart, Kolasch & Birch

[57] ABSTRACT

An electrodynamic loudspeaker which comprises a generally rectangular flat vibrating plate, and first and second magnetic drives for driving the vibrating plate to produce vibrations. The first magnetic drive is so positioned as to drive the vibrating plate at a first location corresponding to one of two line nodes $m_1$ and $m_2$ of vibration of a first predetermined frequency $f_1$ which would be produced when the vibrating plate is driven at the center thereof, whereas the second magnetic drive is so positioned as to drive the vibrating plate at a second location corresponding to one of four line nodes $n_1$, $n_2$, $n_3$ and $n_4$ of vibration of a second predetermined frequency $f_3$ which would be produced when the vibrating plate is driven at the center thereof. Each of all of the line nodes extends in parallel to the shorter sides of the rectangular shape of the vibrating plate.

19 Claims, 33 Drawing Figures

ELECTRODYNAMIC LOUDSPEAKER

The present invention relates to an electrodynamic loudspeaker of a type utilizing a generally rectangular flat vibrating plate.

A typical prior art dynamic loudspeaker of the type referred to above has such a construction as shown in top plan and side sectional views in FIGS. 1(A) and 1(B) respectively, of the accompanying drawings, reference to which will now be made for the discussion thereof.

Referring now to FIGS. 1(A) and 1(B), the prior art electrodynamic loudspeaker comprises a yoke 1 having a central pole piece 2 integrally formed therewith, said yoke 1 being fixedly mounted on and received in a frame or basket 3. The yoke 1 has an annular magnet 4 rigidly mounted thereon with the central pole piece 2 protruding loosely through the central opening in the annular magnet 4. The annular magnet 4 is in turn covered by an annular plate 5 rigidly mounted thereon in coaxial relation therewith with an annular magnetic gap being defined between the peripheral face of the pole piece 2 and the inner peripheral face of the annular plate 5. Positioned above the magnetic drive mechanism of the yoke 1, magnet 4 and plate 5 is a generally rectangular flat vibrating plate 6. This vibrating plate 6 is supported by the frame 3 by means of a flexible edge member 7 interposed between the perimeter of the vibrating plate 6 and that of the frame 3. The loudspeaker also comprises a cylindrical coil bobbin 8 having one end rigidly secured to a central area of the vibrating plate 6 and the opposite end accomodated loosely in the annular magnetic gap, said bobbin 8 also having a voice coil 9 formed thereon and positioned inside the annular magnetic gap. The coil bobbin 8 so positioned is supported by a flexible damper 10 as shown.

In operation, the prior art loudspeaker of the construction described above exhibits modes of vibrations as shown in FIGS. 2(A) and 2(B) of the accompanying drawings. More specifically, when an electrical signal is applied to the voice coil 9, the vibrating plate 6 is driven by the coil bobbin 8, producing vibrations of a frequency corresponding to that of the applied electrical signal. In this way, at frequency $f_1$, the vibrating plate 6 gives rise to a vibration mode M having two nodal lines $m_1$ and $m_2$ parallel to the opposite shorter sides of the rectangular shape of the vibrating plate 6. While at frequency $f_3$, which is higher than the frequency $f_1$, the vibrating plate 6 gives rise to the vibration mode N having four nodal lines $n_1$, $n_2$, $n_3$ and $n_4$ also parallel to the opposite shorter sides of the rectangular shape of the vibrating plate 6.

In the prior art loudspeaker now under discussion, the range of reproduction is determined by the frequencies at which the above described vibration modes are produced, respectively.

FIG. 3 of the accompanying drawings illustrates a sound pressure versus frequency characteristic of the prior art loudspeaker. In the graph of FIG. 3, the frequencies $f_1$ and $f_3$ are the values at which the vibration modes M and N are respectively produced and at which the sound pressure attains a peak value. As can readily be understood from FIG. 3, the reproduction range of the prior art loudspeaker now under discussion exhibits a flat characteristic so far as the applied frequency is not higher than the frequency $f_1$. In general, the frequencies $f_1$ and $f_3$ applicable to an electrodynamic loudspeaker utilizing a rectangular flat vibrating plate are lower than that of a conventional electrodynamic loudspeaker utilizing a vibrating cone. As stated above, the prior art electrodynamic loudspeaker of the type referred to above has the disadvantage in that the reproduction range is relatively narrow.

Accordingly, the present invention has been developed with a view toward substantially eliminating the disadvantage inherent in the prior art electrodynamic loudspeaker of the type utilizing a rectangular, flat vibrating plate and has for its essential object to provide an improved electrodynamic loudspeaker of the type referred to above which is effective to exhibit a relatively wide range of reproduction.

This and other objects and features of the present invention will become clear from the following description taken in conjunction with various preferred embodiments of the present invention with reference to the accompanying drawings, in which:

FIGS. 1(A) and 1(B) are top plan and side sectional views, respectively, of a prior art loudspeaker;

FIGS. 2(A) and 2(B) are schematic diagrams used to explain the vibration modes occurring in the prior art loudspeaker shown in FIGS. 1(A) and 1(B).

FIG. 3 is a graph showing a sound pressure versus frequency characteristic of the prior art loudspeaker;

FIGS. 4(A) and 4(B) are top plan and side sectional views, respectively, of a dynamic loudspeaker according to a first embodiment of the present invention;

FIGS. 5(A) and 5(B) are schematic diagrams used to explain the vibration modes occurring in the loudspeaker shown in FIGS. 4(A) and 4(B);

Figure 4:
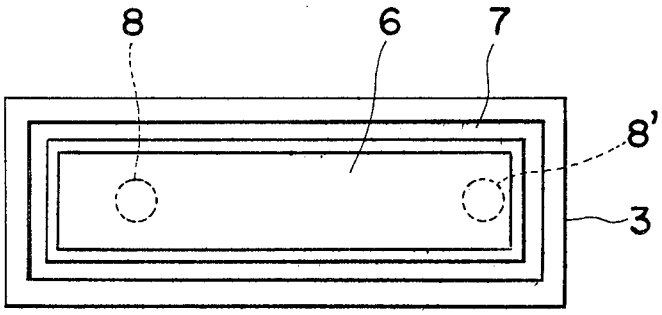
Figure 4:
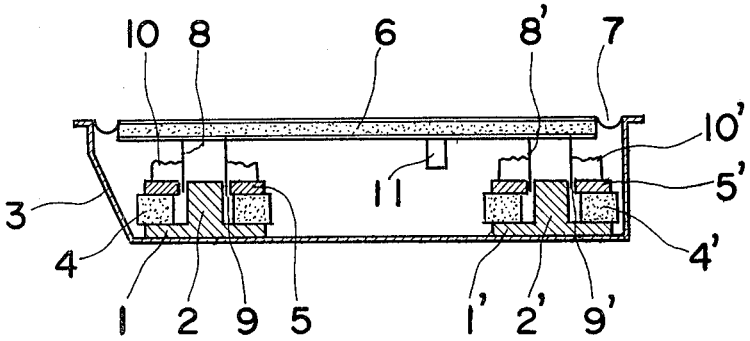
Figure 6:
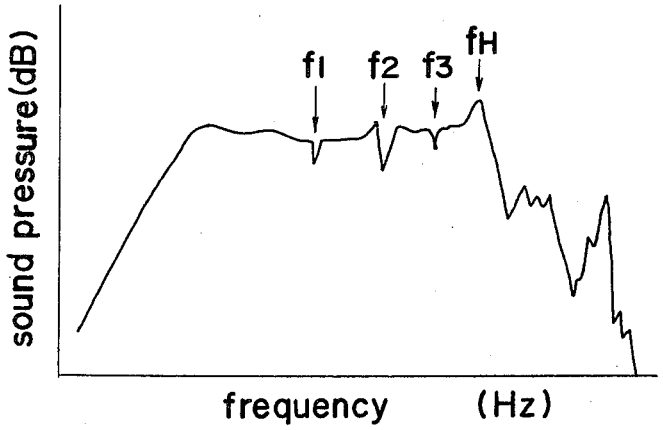
FIG. 6 is a graph showning a sound pressure versus frequency characteristic of the loudspeaker of FIG. 4 with no damper used.
Figure 9A:
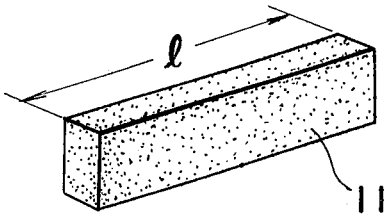
Figure 9B:
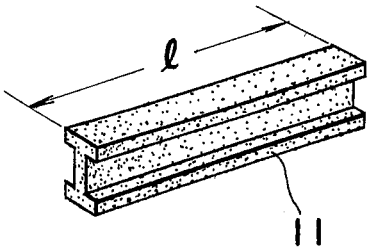
Figure 10A:
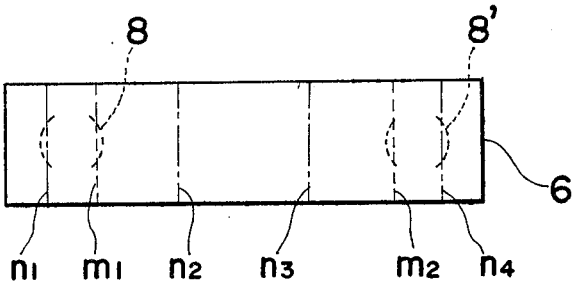
Figure 10B:
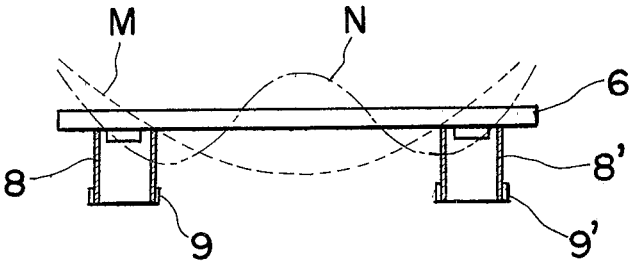
Figure 11:
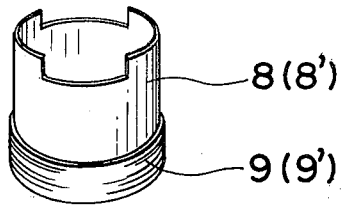
Figure 12A:
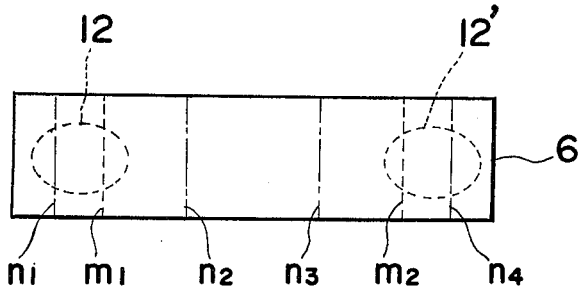
Figure 12B:
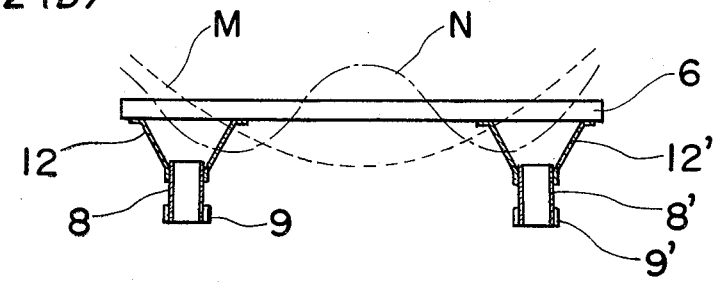
Figure 13A:
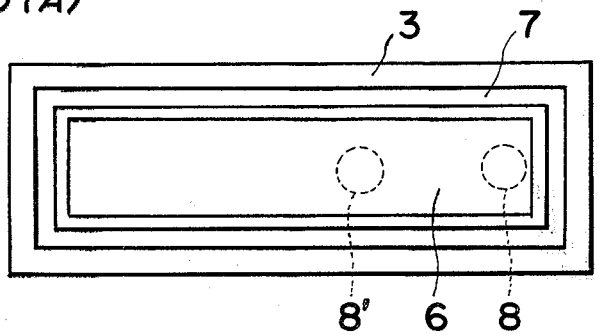
Figure 13B:
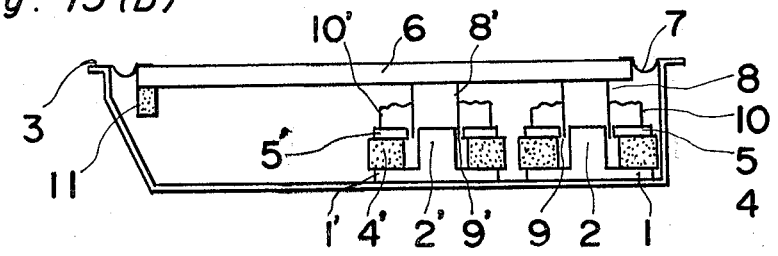
Figure 14A:
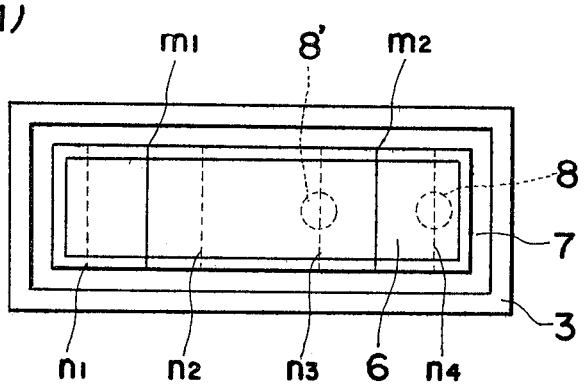
Figure 14B:
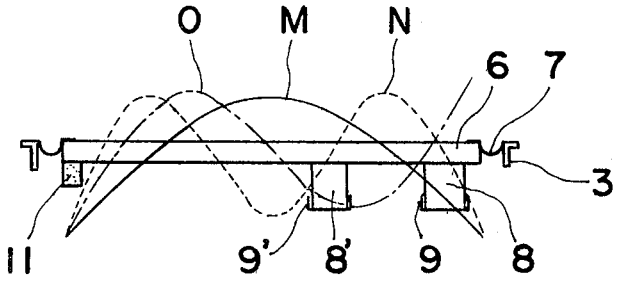
Figure 15A:
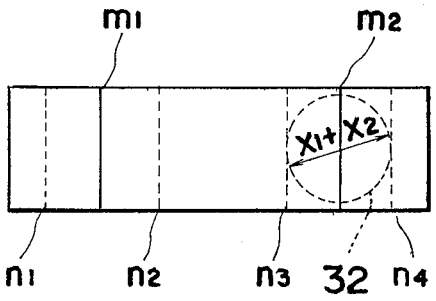
Figure 15B:
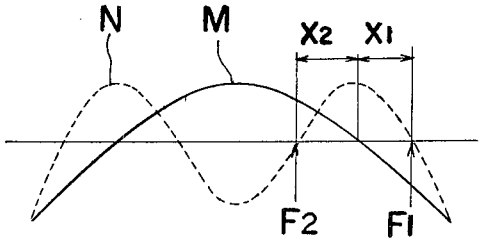
Figure 16:
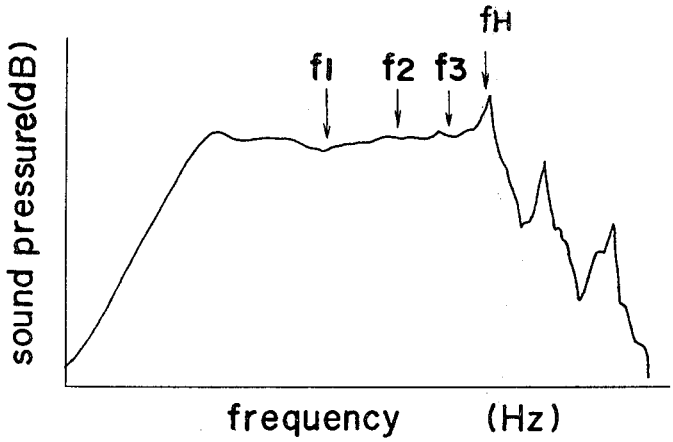
Figure 17:
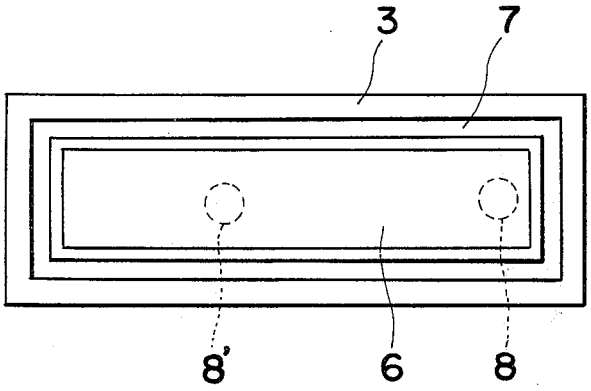
Figure 17:
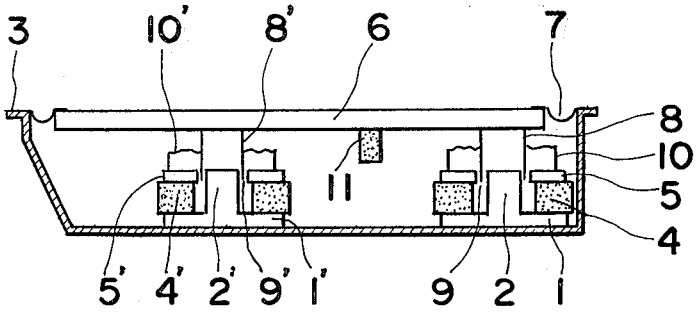
Figure 18:
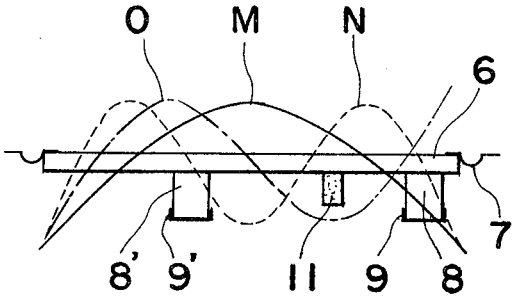
Figure 19:
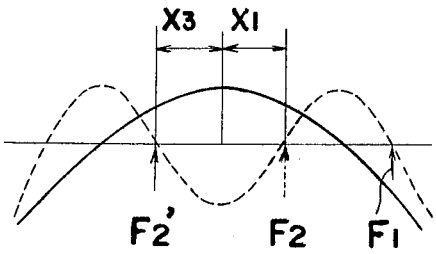
Figure 20A:
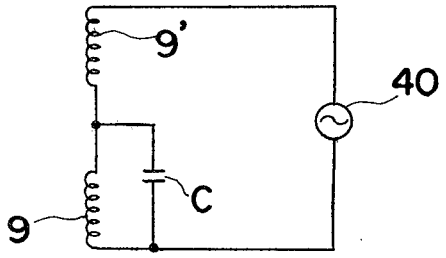
Figure 20B:
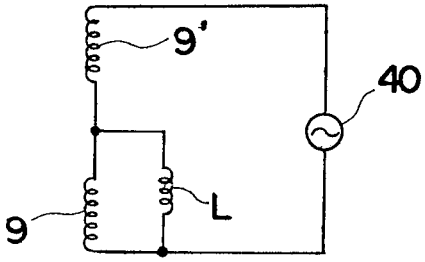
Figure 21:
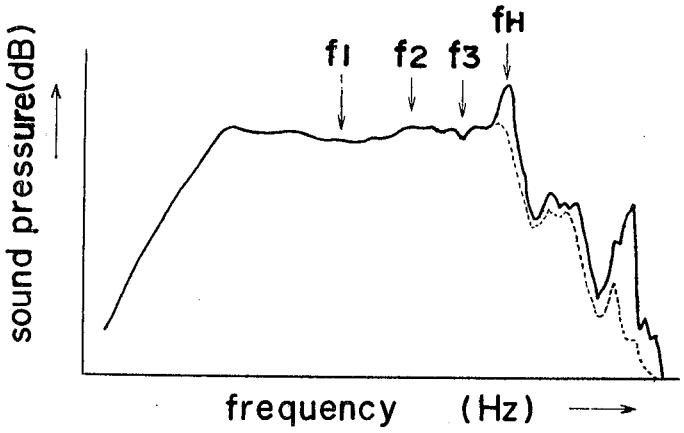

FIGS. 9(A) and 9(B) are perspective views, respectively, showing different types of dampers used in the loudspeakers of the present invention;

FIGS. 10(A) and 10(B) are schematic top plan and side sectional views, respectively, of a loudspeaker according to a third embodiment of the present invention;

FIG. 11 is a perspective view showing a voice coil assembly used in the loudspeaker shown in FIGS. 10(A) and 10(B);

FIGS. 12(A) and 12(B) are views similar to those of FIGS. 10(A) and 10(B), showing the loudspeaker according to a fourth embodiment of the present invention;

FIGS. 13(A) and 13(B) are views similar to those of FIGS. 4(A) and 4(B), showing the loudspeaker according to a fifth embodiment of the present invention;

FIG. 14(A) is a top plan view showing the positional relationship between the voice coils and nodal lines in the loudspeaker of FIGS. 13(A) and 13(B);

FIG. 14(B) is a view similar to FIG. 5(B), but pertaining to the loudspeaker of FIGS. 13(A) and 13(B);

FIG. 15(A) is a schematic diagram showing the relationship between a driving force and nodal lines in the loudspeaker of FIGS. 13(A) and 13(B);

FIG. 15(B) is a schematic diagram showing the relationship between the driving force and the vibration modes in the loudspeaker of FIG. 13(A) and 13(B);

FIG. 16 is a graph similar to FIG. 6, but pertaining to the loudspeaker of FIGS. 13(A) and 13(B);

FIGS. 17(A) and 17(B) are views similar to those of FIGS. 4(A) and 4(B), showing the loudspeaker according to a sixth embodiment of the present invention;

FIG. 18 is a schematic diagram showing the relationship between the voice coils and the vibration modes in the loudspeaker of FIGS. 17(A) and 17(B);

FIG. 19 is a schematic diagram showing the relationship between the vibration modes and the voice coils in the loudspeaker of FIGS. 17(A) and 17(B);

FIGS. 20(A) and 20(B) are schematic circuit diagrams showing different wiring systems for the voice coils used in the loudspeaker of the present invention; and FIG. 21 is a graph similar to FIG. 6, but pertaining to the loudspeaker of FIGS. 17(A) and 17(B).

Before the description of the present invention proceeds, it is to be noted that like parts are designated by like reference numeral throughout FIG. 1 to FIG. 21.

Figure 1A:
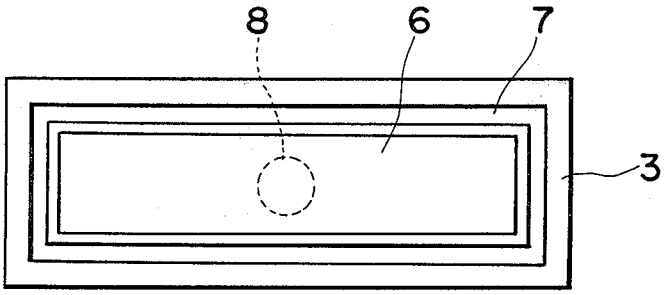
Fig. 1(A) PRIOR ART
Figure 1B:
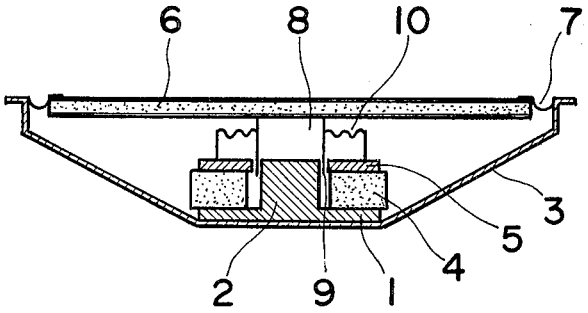
Fig. 1(B) PRIOR ART
Figure 2A:
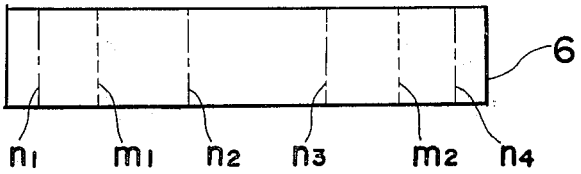
Fig. 2(A) PRIOR ART
Figure 2B:
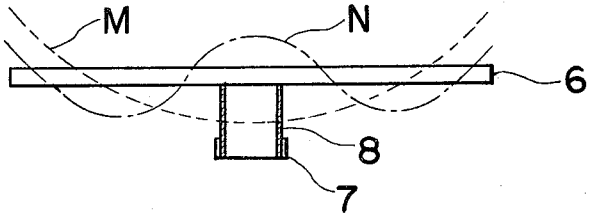
Fig. 2(B) PRIOR ART
Figure 3:
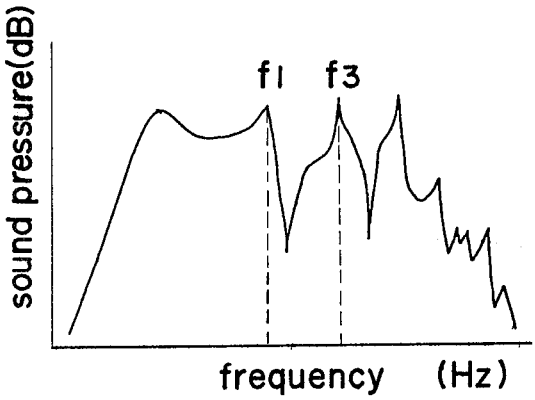
Fig. 3 PRIOR ART

Referring first to FIGS. 4 to 7 and particularly to FIGS. 4(A) and 4(B), the dynamic loudspeaker shown therein includes, in addition to the magnetic drive consisting of elements 1, 2, 4, 5, 8, 9 and 10 as described with reference to FIGS. 1(A) and 1(B), an additional magnetic drive consisting of a yoke 1', having a central pole piece 2', an annular magnet 4', an annular plate 5', and a coil bobbin 8' having a voice coil 9' and a damper 10', all elements being identical with and assembled in a manner similar to the elements 1, 2, 4, 5, 8, 9 and 10. In other words, the vibrating plate 6 in the loudspeaker shown therein is driven by the two magnetic drives to produce sounds.

FIGS. 5(A) and 5(B) illustrate the relation of the positions of the respective coil bobbins 8 and 8' relative to the vibration modes M and N described in connection with the prior art loudspeaker.

As can readily be understood from FIGS. 5(A) and 5(B), according to the embodiment shown in FIGS. 4(A) and 4(B), the coil bobbin 8 is secured to the vibrating plate 6 at a position corresponding to the nodal line $m_1$ of the mode M of vibration which occurs at the frequency $f_1$ when the plate 6 is otherwise driven at a central area in a manner similar to the prior art loudspeaker. On the other hand, the coil bobbin 8' is secured to the plate 6 at a position corresponding to the nodal line $n_4$ of the mode N of vibration which occurs at the frequency $f_3$ when it is otherwise driven at the central area in a manner similar to the prior art loudspeaker.

Figure 7:
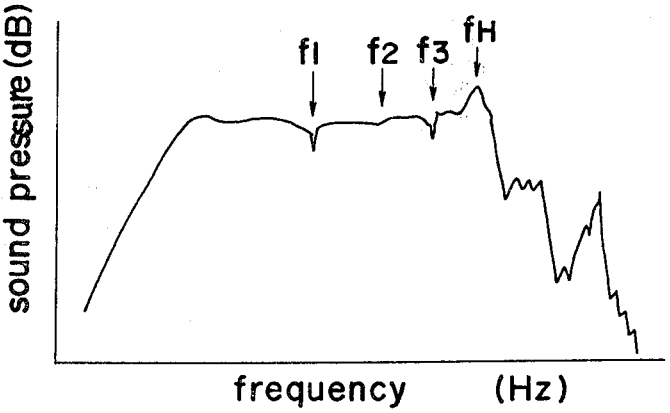
FIG. 7 is a graph similar to FIG. 6 which is shown by the loudspeaker of FIG. 4 with the damper used.

When the vibrating plate 6 is driven at two areas corresponding in position respectively to the nodal lines occurring at the respective frequencies $f_1$ and $f_3$, disturbance in sound pressure which would otherwise occur at the frequencies $f_1$ and $f_3$ is suppressed to a practically negligible value as shown in the graph of FIG. 6 and, therefore, the loudspeaker embodying the present invention can exhibit a relatively large range of reproduction to a resonance frequency $f_h$ higher than the frequency $f_3$ However, since the vibrating plate 6 used in the construction shown in FIGS. 4(A) and 4(B) has two driven areas whereat it is driven by the coil bobbins 8 and 8', which driven areas are in asymmetric relation, there is a possibility that a dip may occur in the sound pressure at a frequency $f_2$, intermediate the frequencies $f_1$ and $f_3$, under the influence of resonance at such intermediate frequency $f_2$. This dip in the sound pressure occurring at the frequency $f_2$ is attributable to the asymmetric relation of the driven areas on the vibrating plate 6, the mode of vibration of which is, as shown by a curve 0, in FIG. 5(B), generally referred to as an asymmetric mode of vibration having three nodes $0_1$, $0_2$ and $0_3$ and has a nature tending to adversely affect the flatness of the sound pressure versus frequency characteristic of the loudspeaker. This possibility can advantageously be eliminated according to the present invention by the utilization of a damping member 11. More specifically, as best shown in FIG. 4(B), this damping member 11 is bonded to the backside face of the vibrating plate 6 at a position intermediate the center of the plate 6 and the position where the coil bobbin 8' responsible to drive at the line node $n_4$ of vibrations of the mode occurring at the frequency $f_3$ is secured to the plate 6. It is to be noted that the position where the damping member 11 is so bonded to the vibrating plate 6 is where the amplitude of vibrations of the asymmetric mode, that is, the mode 0 occurring at the frequency $f_2$, attains the maximum value.

Where the damping member 11 made of such an elastic material, for example, rubber, as having a large internal loss is secured to the vibrating plate 6 in the manner described above, resonant energies occurring at the frequency $f_2$ can be absorbed while the resonance is damped, and, accordingly, as shown in the graph of FIG. 7, the dip in the sound pressure at the frequency $f_2$ is advantageously eliminated, thereby constraining the loudspeaker to exhibit a generally flat sound pressure versus frequency characteristic.

Figure 5:
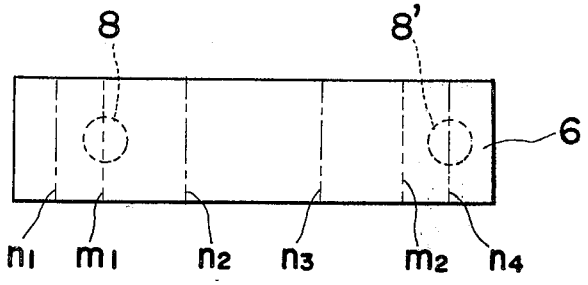
Figure 5:
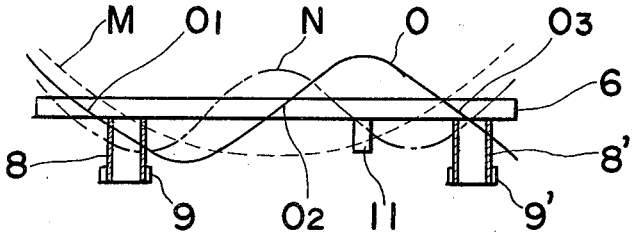
Figure 8:
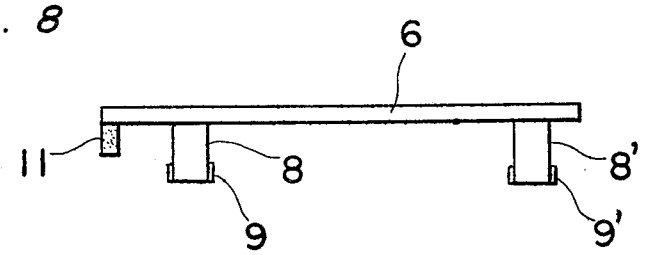
FIG. 8 is a schematic side sectional view of an essential portion of the loudspeaker according to a second embodiment of the present invention.

Referring now to FIG. 8 which illustrates the second preferred embodiment of the present invention, the damping member 11 is shown as secured to the backside face of the vibrating plate 6 at one end of the plate 6 adjacent to the coil bobbin 8. The position where the damping member 11 is so secured in the embodiment of FIG. 8 is also where the amplitude of vibrations of the mode 0 occurring at the frequency $f_2$ as shown in FIG. 5 attains the maximum value.

FIGS. 9(A) and 9(B) illustrate different types of the damping member 11 useable in the practice of the present invention. The damping member 11 shown in each of FIGS. 9(A) and 9(B) has a length l substantially equal to the width of the plate 6, that is, the length of any one of the opposite shorter sides of the rectangular shape of the plate 6.

It is, however, to be noted that the shape of the damping member 11 may not be limited to that shown in each of FIGS. 9(A) and 9(B) and/or that the length l of the damping member 11 may not be equal to the width of the plate 6.

In the third embodiment best shown in FIGS. 10(A) and 10(B), each of the coil bobbins 8 and 8' has a larger diameter sufficient to cause the bobbin 8 or 8' to drive the plate 6 at positions corresponding to the nodal lines $n_1$ and $m_1$ or $m_2$ and $n_4$, respectively. In addition, as best shown in FIG. 11, each bobbin 8 or 8' has one end formed with a pair of opposite cutouts which, are, when it is secured to the plate 6 in the manner as hereinbefore described, brought into registry with a space between the associated nodal lines $n_1$ and $m_1$ or $m_2$ and $n_4$, so that the sound pressure can exhibit a flat characteristic.

In the embodiment shown in FIGS. 12(A) and 12(B), the coil bobbins 8 and 8' are coupled to the vibrating plate 6 by means of generally frusto-conical tubes 12 and 12', respectively, each of said tubes 12 and 12' having a reduced diameter end secured to the corresponding bobbin 8 or 8' and a large diameter end so secured to the plate 6 as to drive the plate 6 at positions corresponding to the associated nodal lines $n_1$ and $m_1$ or $m_2$ and $n_4$. This arrangement is also effective to increase the reproduction range of the loudspeaker.

It is to be noted that, in each of the embodiments shown respectively in FIGS. 10 and 12, since the positions where the coil bobbins 8 and 8' are coupled to the vibrating plate 6, that is, the driven areas of the vibrating plate 6, are in symmetrical relation, the dip which would occur in the sound pressure at the frequency $f_2$ as a result of the asymmetric mode 0 of vibration is minimized, and, accordingly, no damping member 11 which has been described as required in the foregoing embodiment may be employed. However, where the coil bobbin 8 is used to drive the plate 6 at respective positions corresponding to the nodal lines $n_1$ and $m_1$ while the coil bobbin 8' is used to drive the plate 6 at respective positions corresponding to the nodal lines $m_2$ and $n_4$, the use of the damping member 11 is recommended to absorb the resonance energies occurring at the frequency $f_2$ since the driven areas of the plate 6 are in asymmetric relation in such case.

The embodiment shown in FIGS. 13(A) and 13(B) is similar to that shown in FIG. 8 except that the magnetic drives are reversed in position and the coil bobbin 8' is positioned between the center of the plate 6 and the position where the coil bobbin 8 is coupled to the plate 6. In other words, the magnetic drives in this embodiment are so arranged that, as shown in FIGS. 14(A) and 14(B), the bobbins 8 and 8' are coupled to the plate 6 in registry with the nodes $n_4$ and $n_3$, respectively, of the vibration mode N occurring at the frequency $f_3$ such as to permit the vibrating plate 6 to be driven at two areas. Since the two nodal drives of the vibration mode N can be equivalently considered that driving forces $F_1$ and $F_2$ drive the respective nodes $n_3$ and $n_4$ as shown in FIGS. 15(A) and 15(B), the points where the driving forces $F_1$ and $F_2$ act on are expressed by the equations, $X_1 \approx 0.13\,l$ and $X_2 \approx 0.132l$ with respect to the node $m_2$ of the vibration mode M which equations show that the driven areas of the vibrating plate 6 are substantially in symmetrical relation. Accordingly, as shown in FIG. 15(A), the arrangement shown in FIGS. 13(A) and 13(B) can bring about an effect similar to that brought about by the arrangement wherein a coil bobbin 32 of a diameter equal to the sum of the values $X_1$ and $X_2$ is utilized to drive the plate 6 at a position corresponding to the node $m_2$ of the vibration mode M.

Thus, with the loudspeaker according to the embodiment of the present invention, since at least one of the coil bobbins 8 and 8' basically drives the vibrating plate 6 at positions corresponding to at least one of the nodes of the vibration mode N, the frequency $f_3$ can completely be suppressed. In addition, a similar description mode above applies to the vibration mode M occurring at the frequency $f_1$, and, therefore, the frequency $f_1$ can also be completely suppressed.

It is to be noted that, since the driven areas on the vibrating plate 6 in the embodiment shown in FIGS. 13(A) and 13(B) are in asymmetric relation and are liable to the occurrence of the vibration mode 0 at the frequency $f_2$, the damping member 11 is, for the purpose of suppressing this vibration mode 0, secured to the end of the vibrating plate 6 whereat the amplitude attains the maximum value.

If the coil bobbins are used to drive the vibrating plate at positions corresponding to the node $m_1$ of the vibration mode M and the node $n_4$ of the vibration mode N, respectively, the nodal drive by the coil bobbin at node $m_1$ may result in drive at the loop of vibration between the nodes $n_1$ and $n_2$ of the vibration mode N, whereas the nodal drive by the other of the coil bobbin at the node $n_4$ may result in drive at the loop of vibration externally of the node $m_2$ of the vibration mode M. This may in turn result in enhancement of resonance with the consequence that resonance at the frequencies $f_1$ and $f_3$ may not be completely suppressed, bringing about a dip in the sound pressure.

However, the loudspeaker according to the embodiment shown in FIGS. 13(A) and 13(B), as well as the other embodiments of the present invention, is free from the occurrence of the dip in the sound pressure at the frequencies $f_3$ and $f_1$ because the coil bobbins 8 and 8' are so positioned as to drive the plate 6 at the respective positions corresponding to the nodes $n_4$ and $n_3$ of the vibration mode N with the frequencies $f_1$ and $f_3$ consequently being completely suppressed.

The sound pressure versus frequency characteristic of the loudspeaker of the construction shown in FIGS. 13(A) and 13(B) is shown in FIG. 16. From the graph of FIG. 16, it is clear that the dip in the sound pressure which would occur at the resonance frequencies $f_1$ and $f_3$ when the respective nodes of the vibration modes M and N are driven is completely eliminated, giving a flat characteristic to the sound pressure.

The embodiment shown in FIGS. 17(A) and 17(B), is similar to the embodiment shown in FIGS. 13(A) and 13(B), except for the following difference. As shown, the coil bobbin 8 is used to drive the plate 6 at a position corresponding to the node $n_4$ of the vibration mode N while the coil bobbin 8' is used to drive the plate 6 at a position corresponding to the node $n_2$ of the vibration mode N. In addition, the damping member 11, which has been described as secured to the end of the plate 6 in the previous embodiment, is secured to a portion of the plate 6 between the center of the plate 6 and the coil bobbin 8 for suppressing the vibration mode 0 occurring at the resonance frequency $f_2$, which would occur because of the asymmetric relation of the driven areas of the vibrating plate 6.

The driving force exerted by the bobbin 8' in the arrangement of FIGS. 17(A) and 17(B) can be expressed by $F_2'$ as shown in FIG. 19. When this driving force $F_2'$ is compared with the driving force $F_2$ (FIG. 15) exerted by the bobbin 8' in the arrangement of FIGS. 13(A) and 13(B), since the distance from the center of the vibrating plate 6 is $X_3 = X_1$, the driving at the node $n_2$ can be considered equivalent to the driving at the node $n_3$ so far as the vibration mode M is involved. Therefore, the sound pressure versus frequency characteristic of the loudspeaker according to the embodiment of FIGS. 17(A) and 17(B) can also exhibit a flat characteristic.

It is to be noted that, in the embodiment of FIGS. 17(A) and 17(B), the use of the damping member 11 may be obviated provided that the coil bobbins 8 and 8' are used to drive the vibrating plate 6 at the respective positions corresponding to the nodes $n_3$ and $n_4$ and to the nodes $n_1$ and $n_2$, respectively, thereby to render the driven areas to be in symmetrical relation.

In any one of the foregoing embodiments of the present invention, the voice coils 9 and 9' are electrically connected in series with each other and also in series with a source of AC signal. However, where the coil bobbins 8 and 8' are so arranged as to drive the vibrating plate 6 at the respective positions corresponding to the node $m_1$ and the node $n_4$, respectively, while the associated voice coils 9 and 9' are electrically connected in series with each other, a capacitor C may be employed to form a cutoff filter, as shown in FIG. 20(A), for the purpose as will be described later. The filter formed by the capacitor C connected in parallel to the voice coil 9 as shown in FIG. 20(A) is so selected as to have a cutoff frequency equal to about 70% of the harmonic resonant frequency $f_H$. Specifically, assuming that the voice coils 9 and 9' are 19 mm in diameter and have a resistance of 8Ω, and that the harmonic resonant frequency $f_H$ is $2KH_Z$, the capacitance of the capacitor C is about 89μF.

It is to be noted that, as shown in FIG. 20(B), instead of the capacitor C used in FIG. 20(A), an impedance element L may be employed for the same purpose.

Where the filter is connected in parallel to the voice coil 9, the phase and amplitude of an electrical current flowing through the series-connected voice coils 9 and 9', that is, the pattern of distribution of the driving forces, can be controlled at the highest frequency to vary the vibration mode, thereby suppressing the peak value of the sound pressure. Therefore, as shown in FIG. 21, the sound pressure versus frequency characteristic of the loudspeaker illustrates that the harmonic resonant frequency $f_H$ can be suppressed as shown by the broken line to cause the sound pressure to exhibit a flat characteristic.

Although the present invention has fully been described in connection with the various preferred embodiments thereof, it is to be noted that numerous changes and modifications are apparent to those skilled in the art. Such changes and modifications are to be understood as included within the scope of the present invention unless they depart therefrom.

What is claimed is:

1. An electrodynamic loudspeaker having:

a generally rectangular flat vibrating plate having two pairs of opposite sides, the sides of one of said pairs being longer than the sides of the other said pair; and magnetic drive means consisting only of first and second magnetic drives for driving the vibrating plate to produce vibrations, said first magnetic drive being so positioned as to drive the vibrating plate at a first location corresponding to one of two line nodes $m_1$ and $m_2$ of vibration of a first predetermined frequency $f_1$ which would be produced when the vibrating plate is driven at the center thereof, said second magnetic drive being so positioned as to drive the vibrating plate at a second location corresponding to one of four line nodes $n_1$, $n_2$, $n_3$ and $n_4$ of vibration of a second predetermined frequency $f_3$ which would be produced when the vibrating plate is driven at the center thereof, each of all of said line nodes extending in parallel to the shorter sides of the rectangular shape of the vibrating plate.

2. A loudspeaker as claimed in claim 1, further comprising damper means for damping resonant vibrations caused by asymmetrical positioning of said first and second magnetic drives longitudinally of said vibrating plate, said damper means being secured to a portion of the vibrating plate where the amplitude of said resonant vibrations is at a maximum value.

3. A loudspeaker as claimed in claim 1, wherein said first magnetic drive is used to drive at one of the line nodes $m_1$ and $m_2$ and one of the line nodes $n_1$, $n_2$, $n_3$ and $n_4$ while said second magnetic drive is used to drive at the other of said line nodes $m_1$ and $m_2$ and another one of said line nodes $n_1$, $n_2$, $n_3$ and $n_4$.

4. A loudspeaker as claimed in claim 3, wherein each of the voice coil bobbins, respectively constituting said first and second magnetic drives, is formed with a cutout means to make it contact with the vibrating plate at such locations as corresponding to the associated line nodes.

5. A loudspeaker as claimed in claim 3, wherein each of the voice coil bobbins, respectively constituting said first and second magnetic drives, is coupled to the vibrating plate through the intervention of a tube member.

6. A loudspeaker as claimed in claim 3, wherein said one of the line nodes $m_1$ and $m_2$ is $m_1$ and said one of the line nodes $n_1$ to $n_4$ is $n_1$ or $n_2$, and wherein said other of the line nodes $m_1$ and $m_2$ is $m_2$ and said another one of the line nodes $n_1$ to $n_4$ is $n_4$ or $n_3$.

7. A loudspeaker as claimed in claim 3, wherein said first and second magnetic drives are used to drive asymmetrically the vibrating plate at the line nodes $m_1$ and $n_1$ or $n_2$ and the line nodes $m_2$ and $n_3$ or $n_4$

8. A loudspeaker as claimed in claim 7, further comprising a damper means for damping resonant vibrations caused by asymmetrical positioning of said first and second magnetic drives longitudinally of said vibrating plate, said damper means being secured to a portion of the vibrating plate where the amplitude of said resonant vibrations is at a maximum value.

9. A loudspeaker as claimed in claim 1, further comprising a filter element electrically connected in parallel to one of the voice coils forming the respective first and second magnetic drives for suppressing the peak value of sound pressures.

10. A loudspeaker as claimed in claim 9, wherein said filter element is a capacitor.

11. A loudspeaker as claimed in claim 9, wherein said filter element is an inductor.

12. An electrodynamic loudspeaker having:

a basket;

a generally rectangular flat vibrating plate having two pairs of opposite sides, the sides of one of said pairs being longer than the sides of the other said pair supported by said basket through a flexible edge member; and magnetic drive means consisting only of, a first magnetic drive fixedly coupled to the vibrating plate to drive said vibrating plate at a first location corresponding to one of four nodes $n_1$, $n_2$, $n_3$ and $n_4$ of a free mode of vibration, and a second magnetic drive fixedly coupled to the vibrating plate to drive said vibrating plate at a second location corresponding to another one of said four nodes.

13. A loudspeaker as claimed in claim 12, wherein said one of the four nodes is $n_4$ and said another one of the four nodes is $n_3$.

14. A loudspeaker as claimed in claim 12, wherein said one of the four nodes is $n_4$ and said another one of the four nodes is $n_2$.

15. A loudspeaker as claimed in claim 12, further comprising a damping member secured to a portion of the vibrating plate where the amplitude of an asymmetric mode of vibration having three nodes attains a maximum value.

16. A loudspeaker as claimed in claim 12, further comprising a passive element electrically connected in parallel to one of the voice coils forming the respective magnetic drives for flattening a sound pressure versus frequency characteristic of the loudspeaker.

17. A loudspeaker as claimed in claim 16, wherein said passive element is a capacitor.

18. A loudspeaker as claimed in claim 16, wherein said passive element is an inductance element.

19. A loudspeaker as claimed in claim 12, wherein said first and second magnetic drives are used to symmetrically drive the vibrating plates at the nodes $n_1$ and $n_2$ and the nodes $n_3$ and $n_4$, respectively.

* * * * *